US005752206A

United States Patent [19]

Frink et al.

[11] Patent Number: 5,752,206

[45] Date of Patent: May 12, 1998

[54] IN-SITU DECONTAMINATION AND RECOVERY OF METAL FROM PROCESS EQUIPMENT

[76] Inventors: Neal A. Frink, 2524 Halstead St., Cincinnati, Ohio 45214; Daniel D. Burns, 24 Woodland Ave., Florence, Ky. 41042; Paul G. Frink, 151 Vermont Ave., Cincinnati, Ohio 45215; Amy Ciric, 1107 Wareham Ave., #46, Cincinnati, Ohio 45202

[21] Appl. No.: 628,135

[22] Filed: Apr. 4, 1996

[51] Int. Cl.[6] ..... C25C 1/06

[52] U.S. Cl. ..... 588/20; 588/204; 205/702; 205/771; 205/44; 205/45; 205/46; 13/3; 13/26; 13/28; 13/41

[58] Field of Search ..... 588/20, 204; 205/702, 205/771, 44, 45, 46; 134/3, 26, 28, 41

[56] References Cited

U.S. PATENT DOCUMENTS

| | | | |
|---|---|---|---|
| 3,853,725 | 12/1974 | Skarbo . | |
| 3,873,362 | 3/1975 | Mihram et al. | 134/3 |
| 3,988,224 | 10/1976 | Barriere et al. . | |
| 4,214,901 | 7/1980 | Michal et al. . | |
| 4,421,556 | 12/1983 | Windt et al. . | |
| 4,587,043 | 5/1986 | Murray et al. | 134/3 |
| 4,828,759 | 5/1989 | Hanulik . | |
| 4,933,113 | 6/1990 | Hanulik . | |
| 5,008,044 | 4/1991 | Hanulik . | |
| 5,156,722 | 10/1992 | Snyder et al. . | |
| 5,183,541 | 2/1993 | Snyder et al. . | |
| 5,217,585 | 6/1993 | Snyder et al. . | |
| 5,262,019 | 11/1993 | Snyder et al. . | |
| 5,372,794 | 12/1994 | LeMaire et al. . | |
| 5,378,262 | 1/1995 | Muhaylov et al. . | |
| 5,399,322 | 3/1995 | Coltrinari . | |
| 5,439,562 | 8/1995 | Snyder et al. . | |
| 5,458,745 | 10/1995 | Hradil . | |

OTHER PUBLICATIONS

*Draft Environmental Assessment: Proposed Sale of Radio-Actively Contaminated Nickel Ingots Located at the Padudah Gaseous Diffusion Plant,* Jul. 1995.

*Minimum Critical Masses at the Portsmouth Gaseous Diffusion Plant,* Tayloe, Jr. et al., Jun., 1994.

*Contaminated Nickel Scrap Processing,* Compare et al., Dec., 1994.

*Processes for the Decontamination of Metals and Concrete/Brickwork,* Mar. 1, 1992.

*Decontamination of Fast (CPP–666) Fuel Storage Area Stainless Steel Fuel Storage Racks,* Kessinger, Oct., 1993.

*Primary Examiner*—Arun S. Phasge

*Attorney, Agent, or Firm*—Dinsmore & Shohl LLP

[57] ABSTRACT

Processes for in-situ decontamination and recovery of metal from radioactive-contaminated metal which is contained in process equipment, including ancillary systems of process equipment, comprise two basic steps. In the first step, an acid decontamination solution is circulated through the equipment and in contact with the radioactive-contaminated metal for removing the radioactive contaminants and a first surface portion of the metal from the metal-containing equipment. In the second step, an acid digestion solution is circulated through the equipment for removing at least a second portion of the metal which is substantially free of radioactive contaminants. The present methods are particularly suitable for in-situ decontamination and recovery of nickel from radioactive-contaminated nickel diffusion barriers in the cascade converters of uranium gas diffusion plants. The present methods are also suitable for in-situ decontamination and recovery of metal values from inter-stage piping, gas compressor turbines, and other equipment associated with radioactive materials processing.

36 Claims, 4 Drawing Sheets

IN-SITU DECONTAMINATION AND RECOVERY OF METAL FROM PROCESS EQUIPMENT

FIELD OF THE INVENTION

The present invention is directed to processes for in-situ decontamination and recovery of metal from radioactive-contaminated metal-containing process equipment or ancillary systems, i.e., equipment which includes radioactive-contaminated metal. The processes of the present invention are particularly suitable for in-situ decontamination and recovery of nickel from radioactive-contaminated porous nickel-containing cascade converters in a uranium gaseous diffusion plant.

BACKGROUND OF THE INVENTION

Decontamination of radioactive-contaminated process equipment and materials is often needed in the energy and medical fields employing radioactive materials. Many conventional decontamination processes are cumbersome and/or economically unattractive, and result in varying degrees of effective decontamination.

Decontamination of process equipment associated with uranium gaseous diffusion plants at U.S. Department of Energy facilities in Oak Ridge, Tenn., Paducah, Ky. and Portsmouth, Ohio, and other gaseous diffusion plant sites outside of the United States, pose particular problems. The gaseous diffusion plants include cascade converters containing integral porous nickel diffusion barriers which were used to effect separation of $^{235}UF_6$ from $^{238}UF_6$ through Knudsen diffusion. As a result, the porous nickel diffusion barriers contain various radioactive contaminates including $^{234}Th$, $^{234}Pa$, $^{137}Cs$, $^{239}Pu$ (trace), $^{60}Co$, U, $^{99}Tc$, $^{237}Np$ (trace). Predominant contaminates typically found in the porous nickel diffusion barriers include U, $^{99}Tc$, $^{239}Pu$ (trace), and $^{237}Np$ (trace).

Conventional methods for decontaminating and reclaiming radioactively-contaminated metal from process equipment, for example, nickel from the cascade converters of the uranium gaseous diffusion plant process equipment, have proven difficult. For example, the cascade converters are first removed from the processing equipment. This requires transferring each converter, many weighing in excess of 36,000 pounds and being greater than 17 feet in length, to a separate location where they are disassembled and the barrier is removed. Thousands of individual barrier tubes are then cut loose using a high pressure water lance. The barrier material is then hand packed into individual metal canisters, charged to a metal melt furnace and cast into nickel ingots for subsequent decontamination. The slag generated from the metal melt furnace is processed as radioactive waste. It will be apparent that not only are such conventional processes labor intensive and cumbersome, worker exposure to radioactive materials during these handling and processing steps is difficult to avoid.

Additionally, while the metal melt step partitions some of the radioactive contaminates to the slag phase, the resulting nickel ingots are not decontaminated to a sufficiently low level for release of the nickel ingots to the public. Accordingly, additional processes have been proposed for decontaminating the nickel ingots, including various processes currently used in the nickel refining industry and/or processes specifically developed for decontaminating nickel ingots from gaseous diffusion plant cascade converters.

For example, the Snyder et al. U.S. Pat. Nos. 5,156,722, 5,183,541, 5,217,585, 5,262,019, and 5,439,562 disclose various electro-refining processes for decontaminating nickel from an electrolyte solution. The Snyder et al. U.S. Pat. No. 5,439,562 is particularly directed decontamination of nickel ingots by electro-refining nickel from an alkaline solution. The Snyder et al. U.S. Pat. No. 5,262,019 discloses the combination of an ion exchange process for removal of radioactive contaminates followed by an electrolytic recovery step for reclaiming nickel.

The Hradil U.S. Pat. No. 5,458,745 discloses a method for the removal of technetium from radioactive-contaminated metals such as nickel ingots by dissolving the contaminated nickel ingots in acidic solution, and reducing pertechnetate ions to their metallic state through a metal displacement or cementation reaction with a base metal of low reduction potential. Nickel which is substantially free from technetium contamination may then be electrolytically recovered from the solution.

While surface decontamination of radioactive-contaminated structures and facilities has been conducted, such approaches are only appropriate when contamination is confined to the surface of the material, and in depth or volumetric contamination is not present; when it is possible to focus decontamination at the surface layer without disturbing uncontaminated subsurface level layers; and when all surfaces of the material can be reliably monitored for compliance with surface release criteria using conventional surface survey instrumentation. Common surface decontamination techniques include grit blasting, carbon dioxide blasting, electro-polishing and chemical decontamination. In the past, such surface decontamination techniques have not been appropriate for use with significant quantities of contaminated metals in view of the high cost incurred for monitoring even minor quantities of treated metal.

It will be apparent that the prior art methods for decontamination and reclamation of nickel from cascade converters of uranium gaseous diffusion plants are complicated, extensive and expensive, and potentially dangerous in terms of exposure to contaminant materials, whereby the effectiveness of these conventional methods is limited. Accordingly, a need exists for improved methods for decontamination and recovery of metal from radioactive-contaminated process equipment, which methods are both safe and economically attractive. Particularly, a need exists for such methods which are suitable for the decontamination and recovery of nickel from the cascade converters of uranium gaseous diffusion plants.

SUMMARY OF THE INVENTION

Accordingly, it is an object of the present invention to provide improved processes for decontamination and recovery of metal from radioactive-contaminated metal, particularly radioactive-contaminated metal which is contained in process equipment, including ancillary systems of the process equipment, i.e. piping and the like. It is a related object of the invention to provide processes for the decontamination and recovery of metal from radioactive-contaminated metal-containing process equipment which overcome various disadvantages of prior art methods. It is a related object of the present invention to provide processes for decontamination and recovery of metal from radioactive-contaminated porous metal-containing process equipment comprising porous nickel diffusion barriers from cascade converters of a uranium gaseous diffusion plant.

These and additional objects are provided by the processes according to the invention which are directed to the in-situ decontamination and recovery of metal from radioactive-contaminated metal-containing process equipment, including ancillary systems, i.e., equipment which includes radioactive-contaminated metal.

The processes comprise two basic steps. In the first step, an acid decontamination solution is circulated through the equipment and in contact with the radioactive-contaminated metal in order to remove the radioactive contaminant and a first surface portion of the metal from the equipment. The portion of the metal which is removed with the acid decontamination solution is a relatively small portion of the metal contained in the process equipment and desirably constitutes that portion of the metal which is adjacent the contaminants. In the second step of the present processes, an acid digestion solution is then circulated through the metal-containing process equipment for removing at least a second portion of the metal which is substantially free of radioactive contaminants. In further embodiments of the invention, the acid decontamination solution resulting from the first step and containing radioactive contaminants may be subject to further processing to remove the radioactive contaminants for proper disposal, whereby, if desired, the regenerated acid decontamination solution may be reused. In additional embodiments, the pregnant acid digestion solution resulting from the second step of the processes may be subjected to further processing in order to remove and recover digested metal therefrom. The reclaimed metal provides a valuable product which is substantially free of radioactive contaminants. The thus regenerated acid digestion solution may, if desired, be recycled for further use in the inventive processes.

The present processes provide significant advantages over prior art methods. First, the present inventors have recognized that contamination of process equipment such as the nickel diffusion barriers of the cascade converters from a uranium gaseous diffusion plant is essentially a surface contamination problem. Accordingly, the present processes exploit the physical configuration of the contaminated material to remove the contaminants. In the case of the cascade converter diffusion barriers, the nickel material is in the form of a porous matrix, and the present processes remove contamination from the surfaces of the pores. Conventional methods have compounded contamination problems by intentionally converting what is originally a surface contamination problem into a volumetric contamination problem, for example by charging the nickel barrier material to a metal melt furnace and casting the melted nickel into ingots for subsequent decontamination. The present methods however allow for simple partitioning of the contaminated surface layer from the uncontaminated subsurface of the metal substrate. Additionally, in exploiting the physical geometry and configuration of metal-containing process equipment, such as the porous nickel diffusion barriers, the present methods avoid the labor intensive and potentially dangerous structural disassembling procedures conventionally employed in decontaminating equipment such as the cascade converters of the uranium gas diffusion plants. As a result, the present processes provide safe and efficient means for decontaminating and reclaiming metals.

These and additional objects and advantages provided by the processes of the present invention will be more fully apparent in view of the following detailed description.

BRIEF DESCRIPTION OF THE DRAWING

The following detailed description will be more fully understood in view of the drawings in which.

DETAILED DESCRIPTION

Figure 1:
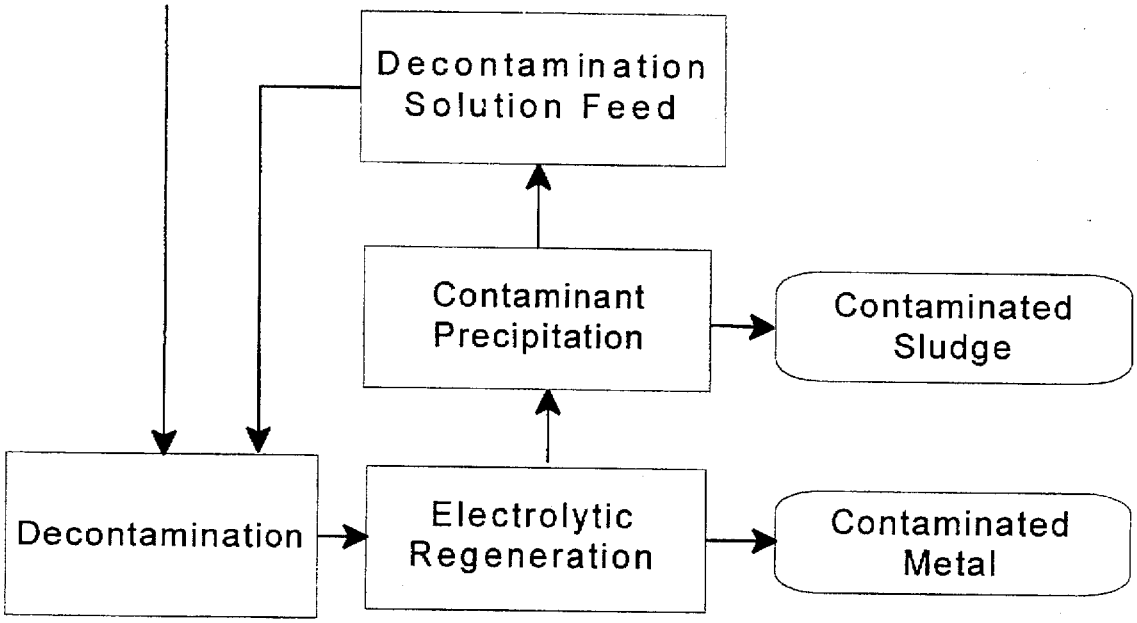
FIG. 1 sets forth a schematic diagram of a preferred embodiment of the decontamination step according to the present processes.

The processes of the present invention are directed to the decontamination and recovery of metal from radioactive-contaminated metal-containing process equipment. Particularly, process equipment having a porous or intricate internal configuration or surface geometry, such as flow-through filters or diffusion barriers, or other process equipment including heat exchangers, gas compressor turbine stages, interstage process piping, pumps, motors, and the like, which is contaminated with radioactive materials during use may be de contaminated according to the present processes to provide recovery of valuable metals.

The present methods are particularly appropriate for the decontamination and recovery of nickel from radioactive-contaminated porous nickel diffusion barriers from the cascade converters of uranium gaseous diffusion plants, for example of the type located in Oak Ridge, Tenn., Paducah, Ky., and Portsmouth, Ohio. The barrier material was usually passivated with hydrofluoric gas to form a nickel fluoride surface layer within the pores of the nickel in order to increase resistance of the diffusion barriers to reaction with $UF_6$ gas, hydrofluoric gas and associated contaminants. The nickel fluoride surface layer has been characterized as comprising approximately 1.2% by weight of the diffusion barrier substrate. The porous nickel diffusion barriers were primarily used to effect the separation of $^{235}UF_6$ from $^{238}UF_6$ through Knudsen diffusion. As noted above, radioactive contaminants in the porous nickel diffusion barriers include $^{234}Th$, $^{234}Pa$, $^{137}CS$, $^{239}Pu$ (trace), $^{60}Co$, U, $^{99}Tc$ and $^{237}Np$ (trace), with the predominant contaminants including U, $^{99}Tc$, $^{239}Pu$ (trace) and $^{237}Np$ (trace). The contaminants are primarily impinged onto or reacted with the nickel fluoride surface layer in the form of chemically active fluorides. The international criteria for release of radioactively contaminated material to non-regulated markets requires a maximum total activity of 74 Bq/g, although some countries have set even lower limits of activity, for example of about 20 Bq/g total activity. The present processes provide for the recovery of metal, particularly nickel in the case of the porous nickel diffusion barriers, which meets these levels.

The processes of the present invention are directed to in-situ decontamination and recovery of metal from radioactive-contaminated metal-containing process equipment and comprise two basic steps. In the first step, an acid decontamination solution is circulated through the process equipment and in contact with the radioactive-contaminated metal to remove the radioactive contaminants and a first surface portion of the metal from the process equipment. The acid which is employed in the decontamination solution should be selected so as to solubilize both the radioactive contaminants and the surface layer of the metal, i.e., nickel fluoride and nickel as in the case of the porous nickel diffusion barriers in the cascade converters of a gaseous diffusion plant. In a preferred embodiment, the acid of the decontamination solution comprises an inorganic acid, and the acid decontamination solution is an aqueous solution. Suitable acids include, but are not limited to, fluoroboric acid, hydrochloric acid, sulfuric acid, nitric acid, and mixtures thereof. In one specific embodiment, a preferred acid decontamination solution comprises an aqueous solution of from about 1 to about 25 weight percent, and more preferably from about 5 to about 10 weight percent, fluoroboric acid. In another embodiment, the acid decontamination solution comprises an aqueous solution of hydrochloric acid, sulfuric acid or nitric acid, which aqueous solution has a normality (N) of from about 1 to about 6, more preferably about 2 to about 4. In yet another embodiment, the acid decontamination solution comprises an organic acid. Suitable organic acids include, but are not limited to, acetic acid, formic acid, oxalic acid, or mixtures thereof.

As the acid decontamination solution circulates through the process equipment and in contact with the radioactive-contaminated metal, reaction of both the radioactive contaminants and the metal substrate will occur. In the case of the porous nickel diffusion barrier, typical reactions include:

$$Ni+2HX \rightarrow Ni(X)_2+H_2$$

(reaction of acid with nickel substrate)

$$NiF_2+2HX \rightarrow Ni(X)_2+2HF$$

(reaction of acid with nickel fluoride substrate coating)

$$UO_2F_2+2HX \rightarrow UO_2X_2+2HF$$

(reaction of acid with uranyl fluoride contaminant)
where HX is a generic monoprotic acid.

In one embodiment of the invention, it is advantageous to include in the acid decontamination solution a surfactant or wetting agent which reduces the surface tension between the acid decontamination solution and the surface of the porous metal, thereby facilitating the passage of the acid decontamination solution through the process equipment. This embodiment is particularly advantageous when the process equipment includes a porous metal substrate. Suitable surfactants will be apparent to one of ordinary skill in the art. In one embodiment, the surfactant may comprise a nonionic surfactant, for example a nonylphenol aromatic ethoxylate. The surfactant or wetting agent may be included in the acid decontamination solution in an amount sufficient to improve the passage of the acid decontamination solution through the pores of a porous metal, for example, in an amount of from about 0.05 weight percent to about 0.3 weight percent, based on the total weight of the acid decontamination solution.

In another embodiment of the present processes, the acid decontamination solution may be heated in order to expedite solubilization of radioactive contaminants and the metal surface layer into the acid decontamination solution. For example, the acid decontamination solution may be heated to a temperature of from about 30° C. to about 90° C., and more preferably from about 40° C. to about 60° C.

In an important embodiment of the present processes, criticality concerns associated with enriched uranium solubilized into the used acid decontamination solution are minimized. First, prior to circulation of the acid decontamination solution in the contaminated process equipment, non-destructive assay techniques known in the art may be used to determine quantities of enriched uranium material in the process equipment. According to known procedures, calculations can be performed to determine if nuclear criticality concerns would reasonably be associated with the introduction of the aqueous acid decontamination solution in the processing equipment. According to U.S. Department of Energy studies, there typically is not a criticality concern with equipment containing $^{235}U$ enriched to less than 2%. For processing equipment having greater than 2% enriched material, it is preferred according to the present invention that the acid decontamination solution is formed of fluoroboric acid so that the boric content in the acid decontamination solution may act as a criticality poison.

In another embodiment of the present processes, the acid decontamination solution may be preloaded with depleted uranium in amount which will allow blend down of the enrichment in the used acid decontamination solution, thereby ensuring that safe critical masses are maintained. One of ordinary skill in the art can determine the quantity of depleted uranium which will be required to be preloaded in the fresh acid decontamination solution based on the determination of the quantity and enrichment of holdup materials in the processing equipment from the aforementioned conventional assay techniques. This embodiment of the invention, wherein the acid decontamination solution is preloaded with depleted uranium, provides several important advantages. First, as discussed above, preloading the acid decontamination solution with depleted uranium assures that the used acid decontamination solution and any treatment residuals generated downstream thereof, have sufficiently low uranium enrichment levels to provide safe mass. Additionally, maintaining uranium enrichment levels below 1 weight percent by preloading the acid decontamination solution assures that contaminated treatment residuals will not be classified as fissile materials under Department of Transportation Regulations, thereby allowing easier transport of the treatment residuals for disposal. Finally, if the preloading of the acid decontamination solution with depleted uranium is controlled to be in an amount to provide uranium enrichment at or below normal enrichment levels of 0.711 weight percent $^{235}U$, contaminated metal recovered from the process may be incorporated into restricted reused products without jeopardizing license limits of the receiving processing facility.

The surface portion of the metal substrate which is removed by the acid decontamination solution should include all of the substrate metal which is effected by the contamination. In the case of the porous nickel diffusion barriers discussed above, the portion of the nickel substrate which is removed by the acid decontamination solution, including the nickel fluoride coating, is preferably not greater than about 5 weight percent of the porous nickel substrate. One of ordinary skill in the art will recognize that the flow characteristics of the acid decontamination solution through the process equipment will be effected by a number of factors including the overall geometry and structure of the process equipment. Flow characteristics will also be effected by the configuration of the metal substrate, including porosity, void fraction and wall thickness, and the viscosity, surface tension, acid strength and temperature of the acid decontamination solution. Additionally, as one of ordinary skill in the art can determine, the quantity of acid decontamination solution required will also depend on the solubilization reaction kinetics and concentration limits for the various contaminants in the acid decontamination solution.

Further, to optimize total flow rate for the acid decontamination solution circulating through the process equipment, either a steady flow or a pulsed flow of the solution may be employed. The pulsed flow configuration will provide a means for obtaining a lower overall flow rate by allowing the flow to be intermittent as the feed pressure cycles above and below a minimum flow pressure. The pulsed flow configuration will also provide an intermittent flushing action at the peak pressure or flow rate, which may facilitate removal of solids, for example, corrosion products, from the metal surface, including internal pores of the porous metal substrate.

During circulation of the acid decontamination solution through the process equipment, hydrogen gas will be evolved. Depending on the composition of the metal substrate and the process conditions, other gases, for example hydrogen fluoride gas, may also be generated. Accordingly, it is advantageous to provide the process equipment with an off-gas removal and treatment system, if one is not previously in place, in order to continuously remove off gases from the process equipment, and/or provide means for removing soluble gases from the used acid decontamination solution. One of ordinary skill in the art may select any number of conventional processes and techniques for off-gas treatment and removal. In one embodiment, hydrogen gas which is evolved can be passed through HEPA and/or acid gas filters, or the like. Similarly, one of ordinary skill in the art may select conventional processes and techniques for removing solubilized gases. In one embodiment, solutions containing hydrogen fluoride can be treated with precipitation agents, for example calcium hydroxide or the like, and the resulting precipitated products may be removed by filtration.

The circulation of the acid decontamination solution is completed once the radioactive contaminant and a first surface portion of the metal substrate have been removed. The process equipment may be drained and flushed of the acid decontamination solution if desired, after which the second main step of the present processes is effected.

More particularly, in the second step of the processes according to the present invention, an acid digestion solution is circulated through the metal-containing process equipment for removing at least a second portion of the metal, which second portion is substantially free of radioactive contaminants and will allow recovery of a significant portion of contaminant-free metal value. The acid which is employed in the acid digestion solution will be selected dependent on the composition of the metal desired for recovery. The acid for the digestion solution may be either inorganic or organic. In one preferred embodiment, the acid digestion solution comprises an inorganic acid, including, but not limited to, hydrochloric acid, sulfuric acid or nitric acid. Suitably, an aqueous solution of hydrochloric, sulfuric or nitric acid having a normality (N) of from about 1 to about 6, more preferably from about 2 to about 4, may be employed. Suitable organic acids for use in the acid digestion solution include, but are not limited to, acetic acid, formic acid, oxalic acid or mixtures thereof.

As in the decontamination step, the acid digestion solution which is circulated through the process equipment may include a surfactant or wetting agent in order to reduce surface tension and facilitate passage of the acid digestion solution through the process equipment. This embodiment is particularly suitable for treatment of porous metal substrates. Suitable wetting agents or surfactants include nonionic surfactants employed in an amount of from about 0.05 weight percent to about 0.3 weight percent. Additionally, in order to accelerate solubilization of the metal substrate into the acid digestion solution, the acid digestion solution may be heated prior to its circulation through the process equipment. Heating the acid digestion solution to a temperature in the range of from about 30° C. to about 90° C., more particularly from about 40° C. to about 60° C., is preferred.

One of ordinary skill in the art will again recognize that the flow characteristics of the acid digestion solution through the process equipment will be determined by a number of factors, including the overall geometry and structure of the process equipment and the metal substrate, and the viscosity, surface tension, acid strength and temperature of the acid digestion solution. Additionally, as with the decontamination step, the acid digestion solution may be provided at a steady flow rate or in a pulsed flow configuration. As noted above, the pulsed flow configuration provides a means for obtaining lower overall flow rates and can facilitate removal of solids, including corrosion products, from internal pores of a porous metal substrate.

During the digestion step, hydrogen gas will be evolved as the metal substrate is digested into the acid solution. The off-gas and dissolved gas treatment techniques discussed above will advantageously be used to remove such gases from the process equipment and/or digestion solution and, in accordance with conventional technologies known in the art, the generated gases may be treated as necessary.

Near the end of the digestion phase, the substrate may be sufficiently weakened through reduction of cross sectional area, intergranular attack, and/or other corrosive mechanisms promoted by the digestion solution such that the remaining undigested substrate or skeleton will experience breakthrough or failure in one or more locations. At this point in the processing, the remaining undigested substrate may be removed from the system with relative ease by methods such as mechanical shearing, mechanical vibration, ultrasonic vibration or the like. The undigested metal is free of contaminants and may be subject to further processing as desired, i.e., the metal may be digested ex-situ, metal melted, or the like.

In one embodiment of the present processes, the circulation of the acid decontamination solution and/or the acid digestion solution may be accompanied by application to the process equipment of energy, for example in the form of ultrasonic waves, to the solution in contact with the metal substrate. The application of energy entrances the efficiency of the respective solution.

In accordance with further embodiments of the invention, both the used acid decontamination solution containing radioactive contaminants and digested metal substrate therein, and the pregnant acid digestion solution may be subjected to further individual processing for removal of their respective constituents. If desirable, the respective constituents of the acid decontamination solution and the acid digestion solution may be removed substantially completely to allow recycle and reuse of the respective solutions.

For example, the loaded or used acid decontamination solution resulting from the first step of the present processes may be regenerated according to a process shown schematically in FIG. 1. Specifically, electrolytic regeneration is employed to remove the various transition metal radioactive contaminants at the cathode of an electrolytic cell. Actinide metals and other metals which cannot be cathodically eliminated are precipitated from solution according to well known techniques and removed via filtration. For example, the contaminants may be precipitated with nickel carbonate in order to maintain a high level of nickel content in the contaminated metal recovered at the cathode of the electrolytic cell. In one embodiment of the invention, wherein the acid decontamination solution has been circulated through processing equipment containing depleted uranium, the depleted uranium may be maintained in the acid decontamination solution in order to serve as preloaded depleted uranium, whereby the acid decontamination solution is suitable for subsequent circulation in processing equipment containing enriched uranium, for example enriched stages of the cascade converters of a uranium gaseous diffusion plant. Accordingly, in the recycle loop for the acid decontamination solution, uranium concentration and enrichment may be conveniently monitored to assure that as the decontamination progresses, the acid solution does not exceed specified enrichment levels.

Figure 2:
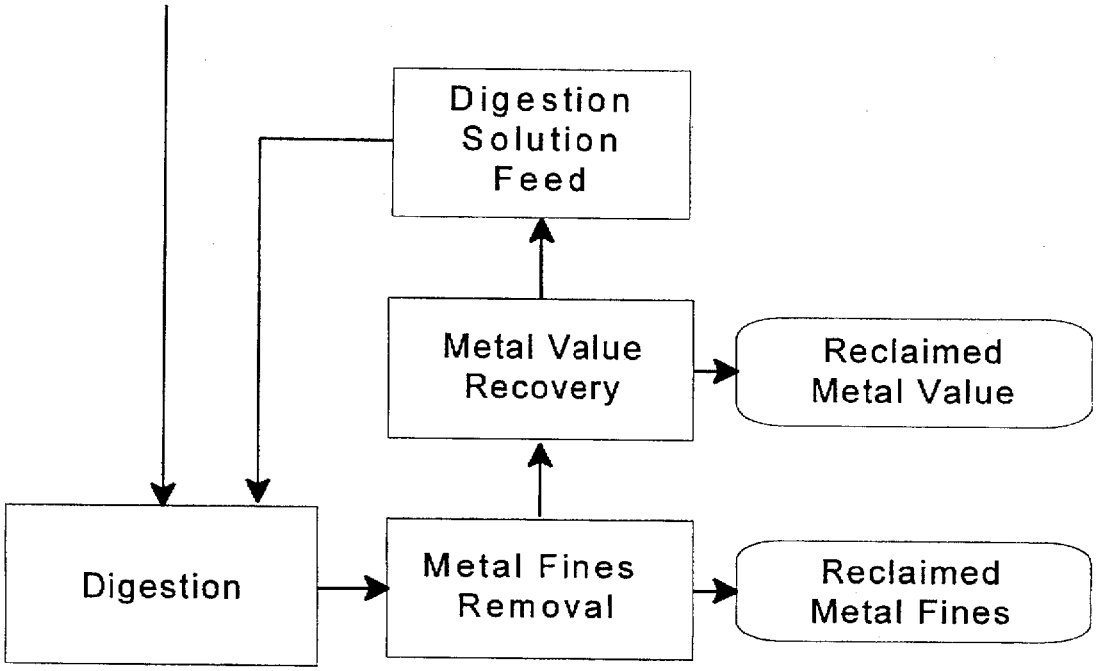
FIG. 2 sets forth a schematic diagram of a preferred embodiment of the digestion step according to the present processes.

FIG. 2 sets forth a schematic diagram of further processing steps for the pregnant digestion solution which results from the second step of the present processes. As shown in FIG. 2, metal fines which may be released from the metal substrate as a result of attack by the acid digestion solution may be removed from the pregnant solution in accordance with any conventional technique known in the art. In the case of the nickel diffusion barriers in the cascade converters of a gaseous diffusion plant, nickel fines will generally be of a size less than about 10 microns in diameter. Accordingly, the fines may be removed, dried and classified, if desired, to produce a high quality, contaminant free fine metal powder. Alternatively, the metal fines may be maintained in the pregnant digestion solution for total digestion and subsequently recovered from the solution with the balance of the digested metal. The acid digestion solution may be subjected to any one of a number of techniques for recovering digested metal value, after which, as shown in FIG. 2, the regenerated acid digestion solution may be recirculated to the processing equipment.

Figure 3:
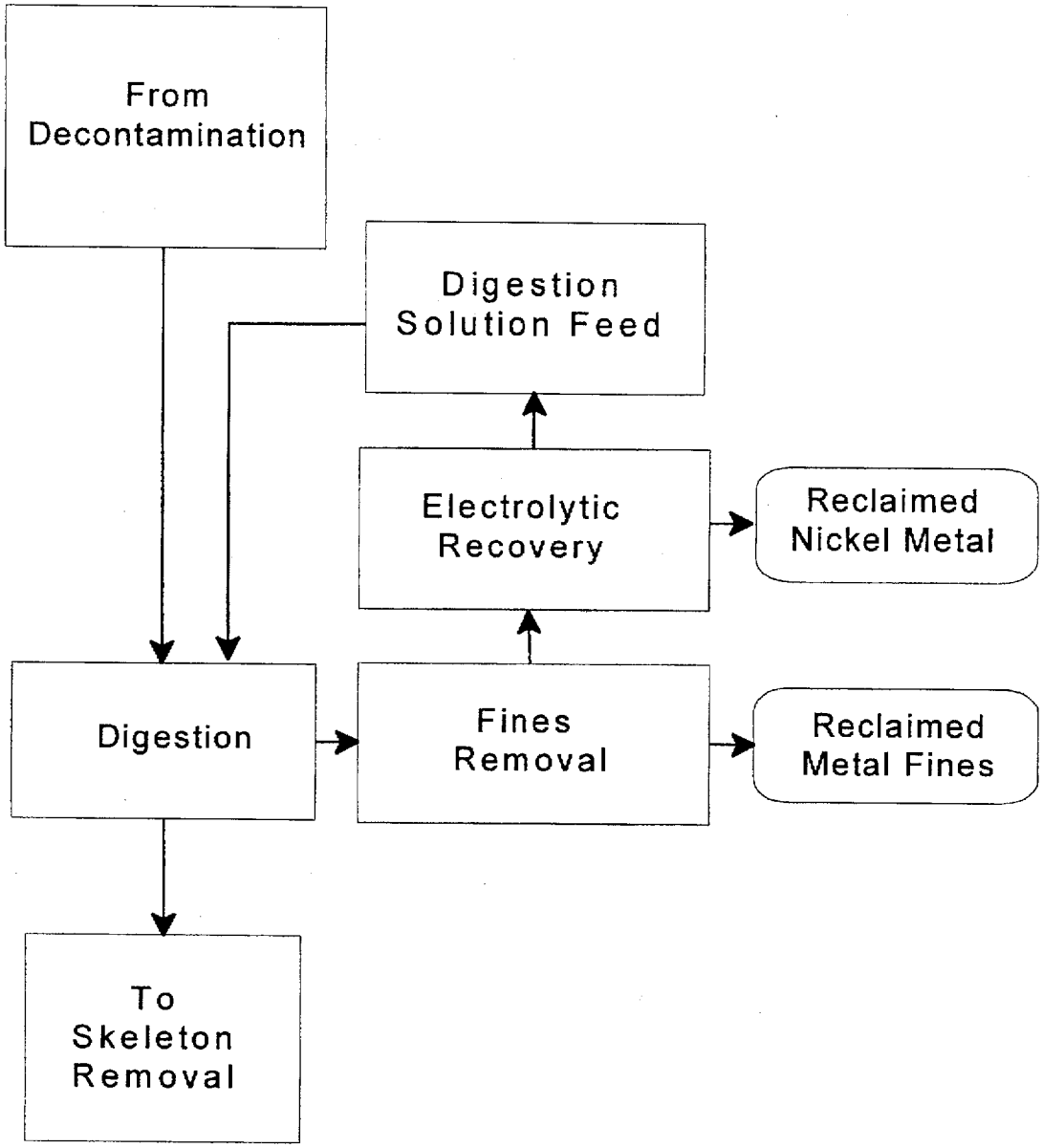
FIG. 3 sets forth a schematic diagram of an electrolytic process for recovering nickel metal from a pregnant digestion solution according to a specific embodiment of the present processes.
Figure 4:
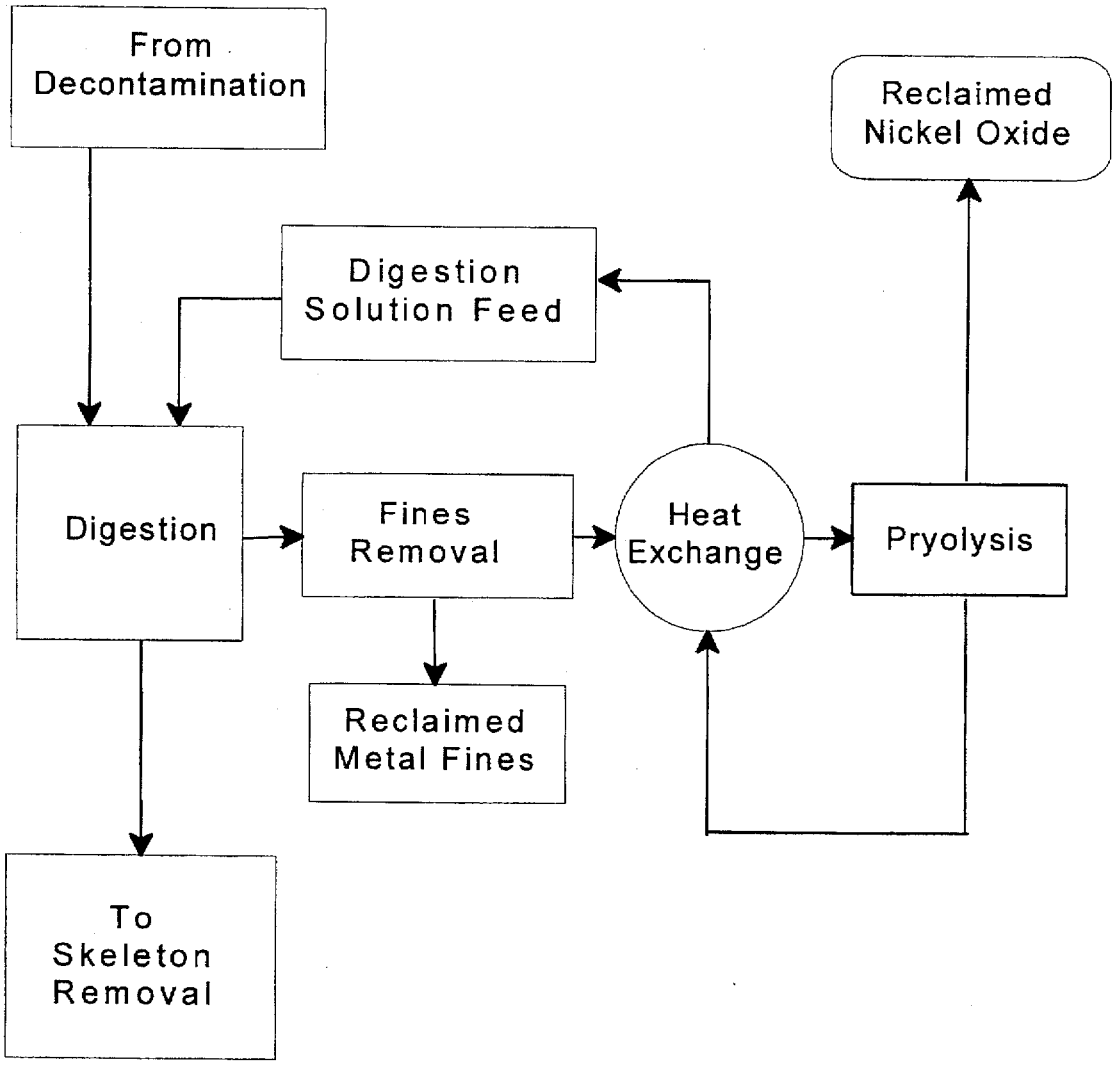
FIG. 4 sets forth a schematic diagram for the pyrolytic process for recovery of nickel oxide from a pregnant digestion solution according to a specific embodiment of the present processes.
Figure 5:
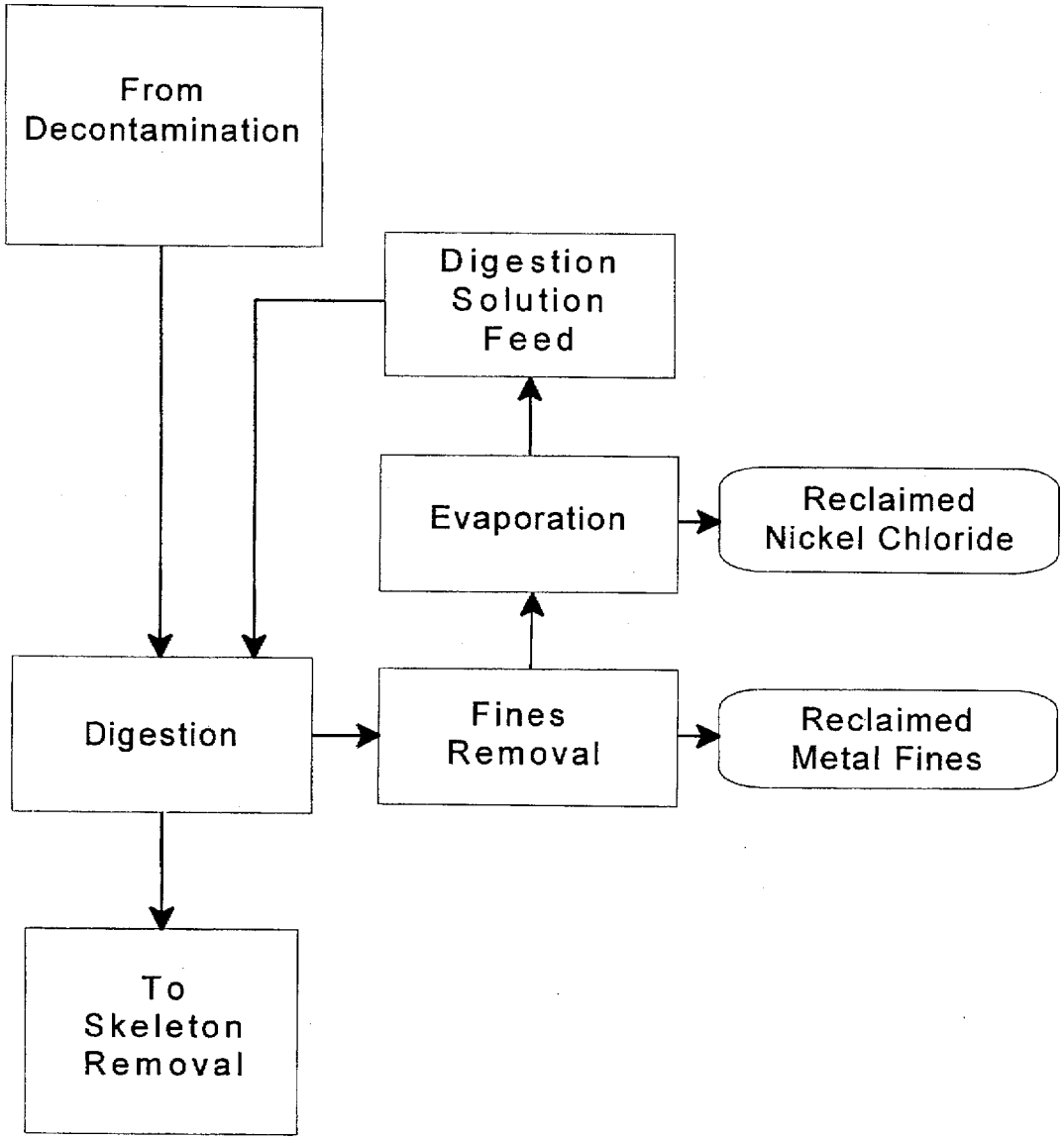
FIG. 5 sets forth a schematic diagram for an evaporation process for recovering nickel chloride from a pregnant digestion solution according to a specific embodiment of the present processes.

FIGS. 3–5 schematically set forth in further detail respective embodiments of processes for the recovery of nickel from a pregnant acid digestion solution resulting from the in-situ recovery of nickel from nickel diffusion barriers in the cascade converters of a uranium gaseous diffusion plant. As shown in FIG. 3, the nickel may be recovered by initial fines removal and subsequent electrolytic processing. Specifically, the nickel is recovered at the cathode of an electrolytic cell, thereby providing a regenerated acid digestion solution for reuse in the processes of the present invention.

Alternatively, as shown in FIG. 4, subsequent to metal fines removal, the pregnant acid digestion solution is preheated and fed to a pyrolysis unit where the nickel is converted to nickel oxide. More particularly the pregnant acid digestion solution contains nickel in the form of a solubilized salt, for example nickel chloride when the acid digestion solution comprises hydrochloric acid. The pyrolysis unit converts the nickel salt solution to nickel oxide and generates an acid gas which may be recovered for reuse in the digestion step. The gaseous fluid resulting from pyrolysis is preferably heat exchanged with the pregnant digestion solution prior to entry of the pregnant digestion solution in the pyrolysis unit, in order to maximize heat recovery. The cooled gas stream is recycled to the digestion solution feed tank where the gas, for example hydrogen chloride gas, may be recovered as acid solution. For example, the partially cooled gas may be bubbled through the acid digestion solution.

In a further alternate embodiment set forth schematically in FIG. 5, the nickel value may be recovered as a salt, for example, nickel chloride salt, by evaporation of the pregnant acid digestion solution and recovery of the nickel salt crystals from the concentrated liquor. More specifically, when the acid digestion solution comprises hydrochloric acid, the resulting nickel chloride solution is preferably chemically purified prior to nickel chloride salt recovery. The nickel chloride solution is heated to about 50° C. to about 70° C. and nickel carbonate is used to raise the pH of the solution to a value of from about 4.8 to about 5.5. An oxidizing agent, preferably from about 0.1 to 1 gallon of hydrogen peroxide per 100 gallons of solution, is added to oxidize contaminant metals, for example iron from the ferrous state to the ferric state. An organic sorbent is added, for example in an amount of from about 1 to 4 pounds activated carbons, per 100 gallons of solution. Finally, a filter aid is added, for example in an amount of from about 0.25 to about 1 pound per 100 gallons of solution, and the solution is filtered through a precoated filter.

The metal value recovered from such processing steps is substantially free of radioactive contaminants, i.e., contains less than about 75 Bq/g radioactivity.

The present description, including specific and preferred embodiments, is set forth to illustrate the processes of the present invention and is not intended to limit the scope of the invention as defined hereafter in the claims. Additional embodiments and advantages within the scope of the present invention will be apparent to one of ordinary skill in the art.

What is claimed:

1. A process for in-situ decontamination and recovery of metal from radioactive-contaminated metal contained in process equipment, comprising (a) circulating through the process equipment and in contact with the radioactive-contaminated metal an acid decontamination solution for removing the radioactive contaminants and a first surface portion of the metal from the equipment, and (b) circulating through the process equipment an acid digestion solution for removing at least a second portion of the metal, the second portion of the metal contains less than about 75 Bq/g radioactivity.

2. A process as defined by claim 1, wherein the radioactive contaminated metal in the equipment comprises porous metal or metal with an intricate surface geometry.

3. A process as defined by claim 2, wherein the porous metal comprises nickel.

4. A process as defined by claim 3, wherein the porous nickel is contaminated with at least one radioactive element selected from the group consisting of $^{234}$Th, $^{234}$Pa, $^{137}$Cs, $^{239}$Pu, $^{60}$Co, U, $^{99}$Tc, $^{237}$Np, and mixtures thereof.

5. A process as defined by claim 3, wherein the radioactive-contaminated porous metal-containing process equipment comprises cascade converters in a uranium gaseous diffusion plant.

6. A process as defined by claim 5, wherein the porous metal in the cascade converters comprises porous nickel having a nickel fluoride coating.

7. A process as defined by claim 1, where the acid decontamination solution comprises an inorganic acid.

8. A process as defined by claim 7, wherein the inorganic acid comprises fluoroboric acid, hydrochloric acid, sulfuric acid, nitric acid, or mixtures thereof.

9. A process as defined by claim 8, wherein the acid decontamination solution comprises from about 1 to about 25 weight percent fluoroboric acid.

10. A process as defined by claim 8, wherein the acid decontamination solution comprises from about 5 to about 10 weight percent fluoroboric acid.

11. A process as defined by claim 8, wherein the acid decontamination solution comprises an aqueous solution of hydrochloric, sulfuric or nitric acid having a normality of from about 1 to about 6.

12. A process as defined by claim 1, where the acid decontamination solution comprises an organic acid.

13. A process as defined by claim 12, where the organic acid comprises acetic acid, formic acid, oxalic acid, or mixtures thereof.

14. A process as defined by claim 1, wherein the acid decontamination solution comprises a nonionic surfactant.

15. A process as defined by claim 1, wherein the acid decontamination solution is at a temperature of from about 30° C. to about 90° C.

16. A process as defined by claim 1, wherein the first portion of porous metal comprises not greater than about 5 weight percent of the porous metal contained in the process equipment.

17. A process as defined by claim 1, wherein the acid decontamination solution includes depleted uranium in an amount sufficient to blend down $^{235}U$ enrichment of the contaminant-containing acid decontamination solution resulting from step (a) to less than 1 weight percent.

18. A process as defined by claim 1, wherein the acid digestion solution comprises an inorganic acid.

19. A process as defined by claim 18, wherein the acid digestion solution comprises an aqueous solution of hydrochloric, sulfuric or nitric acid having a normality of from about 1 to about 6.

20. A process as defined by claim 1, wherein the acid digestion solution comprises an organic acid.

21. A process as defined by claim 20, wherein the acid digestion solution comprises acetic acid, formic acid, oxalic acid or mixtures thereof.

22. A process as defined by claim 1, wherein the acid digestion solution is at a temperature of from about 30° C. to about 90° C.

23. A process as defined by claim 1, wherein the acid digestion solution comprises a nonionic surfactant.

24. A process as defined by claim 1, wherein the second portion of the metal contains less than about 20 Bq/g radioactivity.

25. A process as defined by claim 1, wherein at least one of the acid decontamination solution flow and the acid digestion solution flow is pulsed through the process equipment.

26. A process as defined by claim 1, wherein the efficiency of at least one of the acid decontamination solution and the acid digestion solution is enhanced by adding energy in the form of ultrasonic waves to the solution in contact with the metal substrate.

27. A process as defined by claim 1, wherein at least one of the acid decontamination solution from step (a) and the acid digestion solution from step (b) is filtered to remove metal fines therefrom.

28. A process according to claim 1, wherein the acid decontamination solution from step (a) containing radioactive contaminants removed from the metal is subjected to an electrolytic regeneration treatment to remove radioactive contaminants therefrom.

29. A process according to claim 1, wherein radioactive contaminants contained in the acid decontamination solution from step (a) are precipitated from the solution and filtered therefrom.

30. A process according to claim 1, wherein the acid decontamination solution from step (a) containing radioactive contaminants and the first portion of the metal is subjected to treatment to remove the radioactive contaminants and the digested metal, and the resulting regenerated acid decontamination solution is recycled for further use.

31. A process according to claim 1, wherein the pregnant acid digestion solution resulting from step (b) is subjected to electrolytic treatment to remove digested metal therefrom.

32. A process as defined by claim 1, wherein the pregnant acid digestion solution resulting from step (b) is subjected to pyrolysis to recover the digested metal therefrom.

33. A process as defined by claim 1, wherein the pregnant acid digestion solution resulting from step (b) is subjected to heating to cause evaporation and metal salt precipitate is recovered from the concentrated liquor.

34. A process as defined by claim 30, wherein prior to heating, the acid digestion solution is combined with an oxidizing agent to oxidize any ferrous iron to ferric iron and the ferric iron is removed from the acid digestion solution.

35. A process according to claim 1, wherein the pregnant acid digestion solution from step (b) is subjected to treatment to remove the digested metal, and the resulting regenerated acid digestion solution is recycled for further use.

36. A process as defined by claim 1, where the radioactive contaminated metal-containing equipment comprises gas compressor turbines, heat exchangers, interstage piping, pumps or motors.

* * * * *